US005893711A

United States Patent [19]

Vogelzang et al.

[11] Patent Number: 5,893,711

[45] Date of Patent: Apr. 13, 1999

[54] SPACE HEATER WITH PLASTIC FUEL TANK

[75] Inventors: Steven J. Vogelzang, Holland; John C. Brandt, Grand Rapids, both of Mich.

[73] Assignee: Vogelzang International Corporation, Holland, Mich.

[21] Appl. No.: 08/999,120

[22] Filed: Dec. 29, 1997

[51] Int. Cl.[6] ..... F24H 1/00

[52] U.S. Cl. ..... 432/222; 126/110 B

[58] Field of Search ..... 126/110 B, 110 C, 126/110 D; 432/222

[56] References Cited

U.S. PATENT DOCUMENTS

| | | | |
|---|---|---|---|
| D. 135,577 | 4/1943 | Holthouse . | |
| 1,320,973 | 11/1919 | Bertrau . | |
| 2,231,445 | 2/1941 | Grapp | 263/19 |
| 2,410,353 | 10/1946 | McCollum | 126/116 |
| 2,994,520 | 8/1961 | Sherman | 263/19 |
| 3,073,583 | 1/1963 | Woollen, Jr. | 263/19 |
| 3,240,256 | 3/1966 | Brinkley et al. | 158/96 |
| 3,256,003 | 6/1966 | Briggs | 263/19 |
| 4,081,238 | 3/1978 | Briggs et al. | 432/222 |
| 4,089,642 | 5/1978 | Briggs et al. | 432/222 |
| 4,201,544 | 5/1980 | Briggs et al. | 432/222 |
| 4,288,218 | 9/1981 | Obinata | 432/222 |
| 4,313,417 | 2/1982 | Briggs et al. | 126/110 B |
| 4,340,362 | 7/1982 | Chalupsky et al. | 432/222 |
| 4,357,929 | 11/1982 | Johnson | 126/96 |
| 4,443,187 | 4/1984 | Shaftner et al. | 432/222 |
| 4,532,914 | 8/1985 | Thomas et al. | 126/110 C |
| 5,054,740 | 10/1991 | Wheeler | 248/675 |
| 5,417,401 | 5/1995 | Thompson et al. | 248/674 |

FOREIGN PATENT DOCUMENTS

| | | |
|---|---|---|
| 5535876 | 3/1980 | Japan . |
| 2021249 | 11/1979 | United Kingdom . |

*Primary Examiner*—Carroll B. Dority

*Attorney, Agent, or Firm*—Price, Heneveld, Cooper, DeWitt & Litton

[57] ABSTRACT

A portable space heater in which a plastic tank is utilized underneath a relatively heavy heater unit. The plastic tank is protected against stresses exerted on it by the heater unit by a unique support structure that is supported on the same portable frame as the plastic tank.

22 Claims, 4 Drawing Sheets

SPACE HEATER WITH PLASTIC FUEL TANK

This invention relates to a space heater and particularly a portable space heater in which the fuel of the space heater is contained within a plastic tank. More particularly, this invention relates to such a space heater having a plastic fuel tank in combination with a unique structure for supporting the heater unit above the plastic tank on the frame of the portable heater so as to substantially eliminate any detrimental stress being exerted on the plastic tank by the weight of the heater unit.

BACKGROUND OF THE INVENTION

Portable heaters of the type that included a metal tank over which is mounted a heater unit generally of a cylindrical shape have existed for a long time and have been the subject of much development efforts. Examples of this type of portable heater is disclosed in U.S. Pat. Nos. 4,081,238, 4,089,642, and 4,340,362. To our knowledge, this type of portable heater has always included a fuel tank constructed of metal such as steel. Such tanks have always been mounted on frames constructed in many instances of tubular piping and the frame has been mounted on wheels making the heater portable.

Further, to our knowledge, generally the heater unit which included a combustion chamber with a motor driven fan mounted within a cowling have been mounted directly on the top of the metal tank. As previously stated, efforts have been made to develop better and less costly portable heaters of this type with many different improvements having been made over the years.

The present invention is an improvement of this type of portable heater. Such improvement making the heater less costly to manufacture and also much lighter in weight which is important in portable heaters of this type.

SUMMARY OF THE INVENTION

The present invention involves the concept of utilizing a plastic tank in lieu of the metal tanks which to our knowledge have been used throughout the years although plastic tanks have been available for many different uses, particularly for carrying fuel or replenishing the apparatus which utilizes such fuel.

This invention also involves a unique concept for supporting the heater unit i.e., the combustion chamber, the fan and its motor, and all of the accessories necessary for operating the heater. This unique support for the heater unit includes a support structure supported on the same frame on which the tank is mounted. This support structure supports the cradle for the heater unit so as to substantially eliminate any stress being exerted on the plastic tank by the weight of the heater unit. This structure is in contrast to the prior art portable heaters of this type in which the heater unit is mounted on a cradle which is supported directly on the top surface of the metal tank.

More specifically, the cradle which includes a support surface on which the heater unit is supported is supported by legs extending downwardly from the cradle and supported directly on the portable frame. The support members which extend downwardly from the cradle each include a part extending radially outwardly of at least portions of the sides of the tank and over the tank to the frame which includes two longitudinally extending support members on each side of the tank.

Our invention includes at least two embodiments. One embodiment includes a cradle mounted on two downwardly extending legs which at the extreme lower ends include a flange. The legs extend downwardly beyond at least a portion of the tank and the flanges are mounted on the same frame as the tank is mounted. The legs of this first embodiment are one-piece supporting the cradle between the two legs.

Another embodiment includes two parts comprising an inverted U-shaped member having a bight portion extending laterally across and over the tank and a cradle supported on the bight portion. In this embodiment the bight portion is supported by legs extending from the bight portion and supported on the frame. The other piece comprises a cradle supported on legs mounted on the bight portion. The legs formed on the inverted U-shaped member include flanges extending away from the sides of the tank and supported on the same frame as the tank. In other words, the downwardly supporting members that support the cradle includes two spaced legs mounted on top of the bight portion of the inverted U-shaped member and leg extensions of the inverted U-shaped member include flanges mounted on the frame.

Having briefly described our invention, these and other features, advantages and objects of the present invention will be further understood and appreciated by those skilled in the art by reference to the following specification, claims and appended drawings.

DETAILED DESCRIPTION OF PREFERRED EMBODIMENT

FIRST EMBODIMENT

Figure 1:
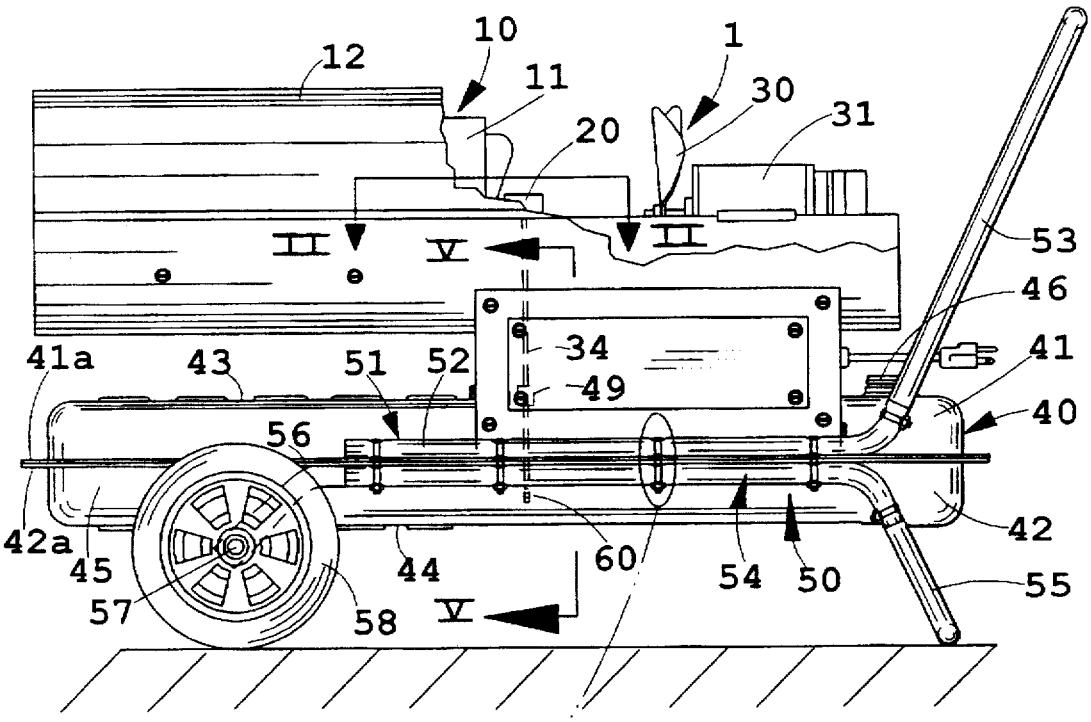
FIG. 1 is a side elevational view of the portable heater with the first unique support structure for supporting the heating unit above the plastic tank.

Referring to the drawings, FIGS. 1–6 disclose one embodiment of the portable heater of this invention. Reference numeral 1 designates the portable heater which includes the heater unit 10 comprising a combustion chamber 11 located within the cowling 12. A nozzle assembly 20 (FIGS. 1 and 2) is mounted at one end of the combustion chamber by the bracket 21 which also supports the ignitor 22 which in this instance is disclosed as a spark plug as is well-known in the art. The ignitor 22 is located immediately adjacent the nozzle 20 for igniting the fuel, which ignition is supported by an air supply means not disclosed. Suffice it to say that the combustion of the fuel takes place within the combustion chamber 11.

Located rearwardly of the heating unit 10 is a fan 30 driven by the motor 31 . The fan forces air through the heating unit 10 into the space to be heated. The nozzle is supplied fuel from the tank through the rigid tube 34. The nozzle assembly 20, fan 30 and fan motor 31 and other accessory items required to operate the heater are also located within the cowling 12 as is well-known in the art. It should be understood the aforegoing sketchy structural description of the components of the portable heater provides the environment for the improved combination of the present invention, the features of which will now be more particularly described.

Figure 4:
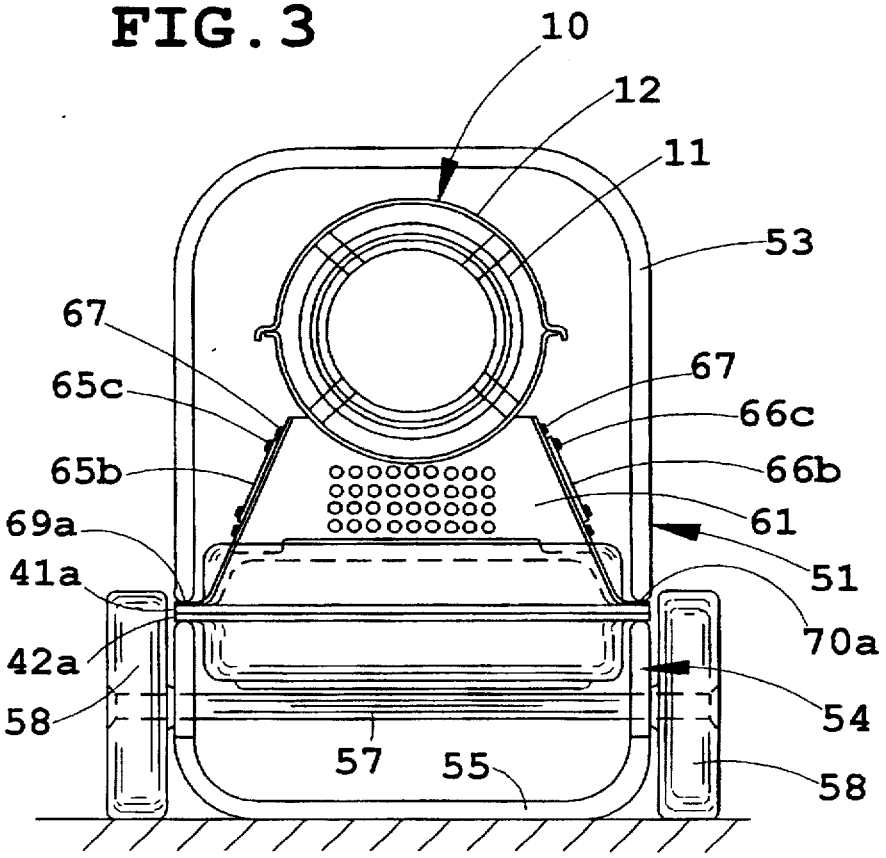
FIG. 4 is a front elevational view of the portable heater of FIG. 1.
Figure 5:
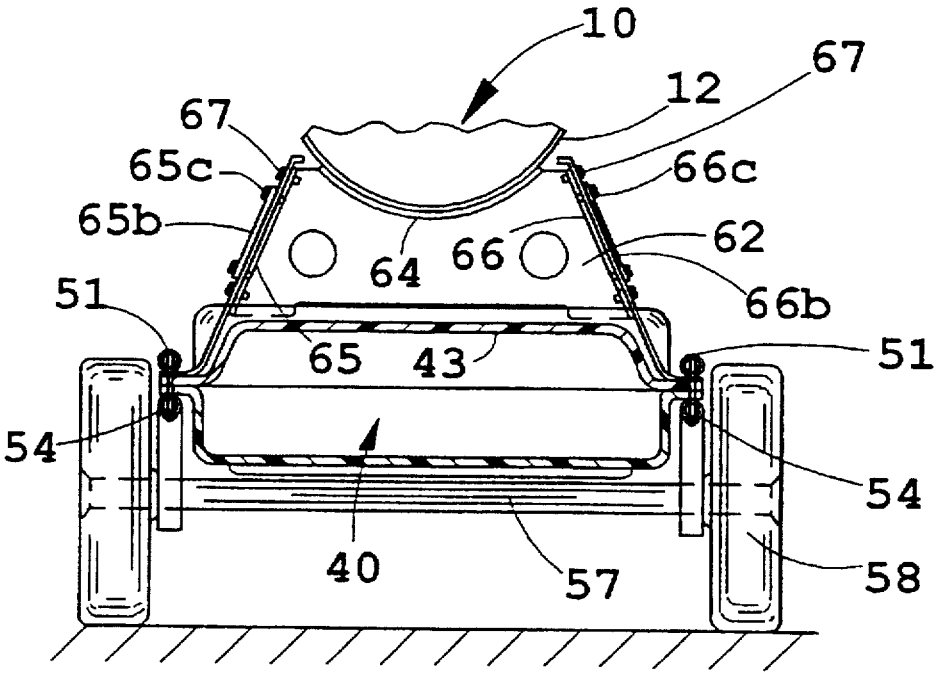
FIG. 5 is a partial cross-sectional view taken along the plane V—V of FIG. 1.
Figure 6:
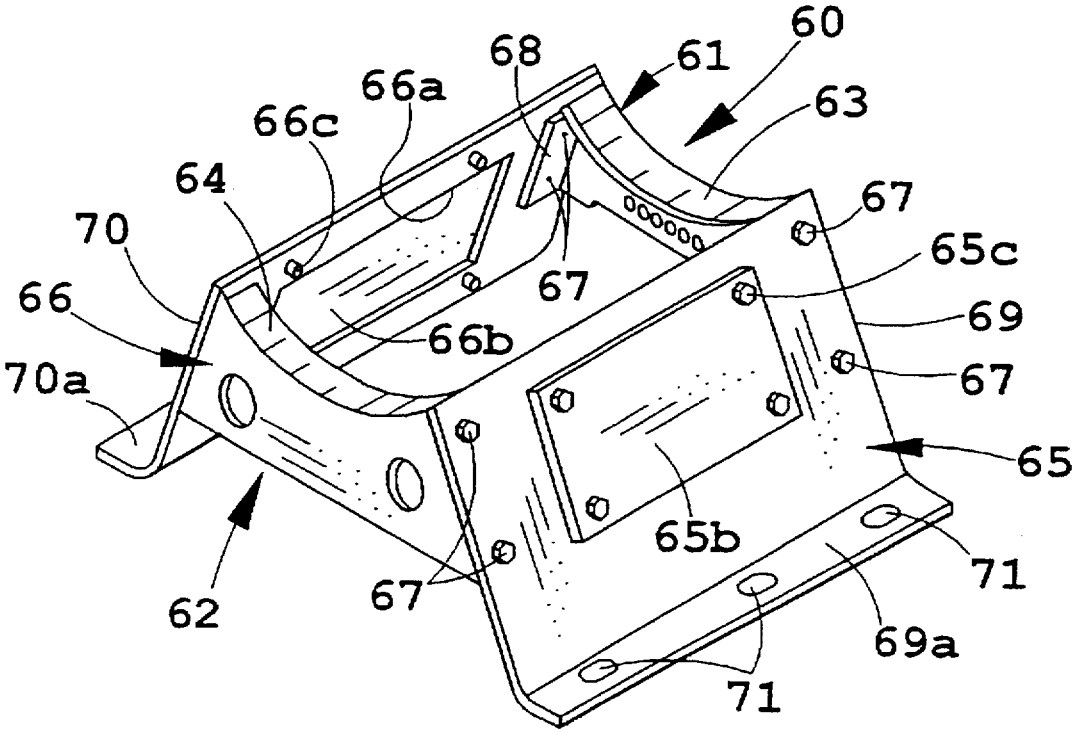
FIG. 6 is a perspective view of the support structure for the saddle of the first embodiment as disclosed in FIGS. 1–5.

Referring to FIG. 6 in conjunction with FIGS. 1–5, it should be understood that the important aspect of this invention resides in the utilization of a plastic tank and the structure as disclosed in FIG. 6 for supporting the heating unit 10 above the tank without exerting any substantial stress on the plastic tank.

Referring to FIGS. 1, 1A, and 3–5, the plastic tank 40 is formed of two parts, 41 and 42, secured together at their peripheries to form the top wall 43, the bottom wall 44, and the side walls 45. A capped opening 46 is provided through which fuel can poured into the interior of the tank 40. A second opening is provided in which a closure member having a threaded or tapped opening (not disclosed) receiving a fitting assembly 49 is provided for connecting the rigid tube 34 to a tube extending into the tank on the end of which is a filter 60. This entire connection is disclosed in the copending application Ser. No. 08/639,035, filed Apr. 16, 1996, now U.S. Pat. No. 5,766,003 and entitled SPACE HEATER WITH NOVEL FUEL LINE ASSEMBLY. This connection could also be the structure as disclosed in my copending application Ser. No. 08/976,922, filed Nov. 24, 1997, and entitled SPACE HEATER WITH NOVEL FUEL LINE ASSEMBLY.

As will be noted from FIGS. 1, 1A, and 3–5, the two parts 41 and 42 of tank 40 include flanges 41*a* and 42*a* extending around the entire periphery of the parts. These two flanges abut and are secured to each other to provide the enclosed tank 40.

Tank 40 is mounted on a wheeled frame 50 which includes an upper tubular member 51 having a horizontally extending portion 52 connected to a handle portion 53. Frame 50 also includes the lower tubular support member 54 extending horizontally below the tubular member 51 and bent downwardly to provide a foot 55 at the rear end and a forwardly bent portion 56 which supports the shaft 57 on which the wheels 58 are rotatably mounted. The side portions of the flanges 41*a* and 42*a* are secured between the tubular members 51 and 54 by bolts 59 extending through openings in the horizontal portions of the tubular members 51 and 54 and in the side portions of the flanges 41*a* and 42*a* all as best disclosed in FIG. 1A.

Now referring to FIG. 6, a support structure 60 for supporting the heating unit 10 is disclosed. It discloses a saddle structure comprising the end plates 61 and 62 both of which include the concave shaped flanges 63 and 64, respectively, having a curvature conforming to the curved shape of the cowling 12 of heater unit 10 so as to provide a curved surface to support the heater unit 10. The plates 61 and 62 are supported by the side support plates 65 and 66 by means of bolts 67 extending through the plates 65 and 66 and secured to flanges 68 of the plates 61 and 62. Plates 65 and 66 extend downwardly and are inclined outwardly of each other to provide the legs 69 and 70. Both legs 69 and 70 include flanges 69*a* and 70*a*, respectively. As disclosed in FIGS. 1 and 3–5, legs 69 and 70 extend downwardly beyond the sides of the top part 41 of plastic tank 40 and are secured between the tubular elements 51 and 53 by the bolts 58 extending through the openings 71 of the flanges 69*a* and 70*a*. Thus, the saddle formed by the flanges 63 and 64 of the plates 61 and 62 are supported entirely by the frame 50. This eliminates any stress being exerted on the top wall 43 of the plastic tank 40.

Figure 3:
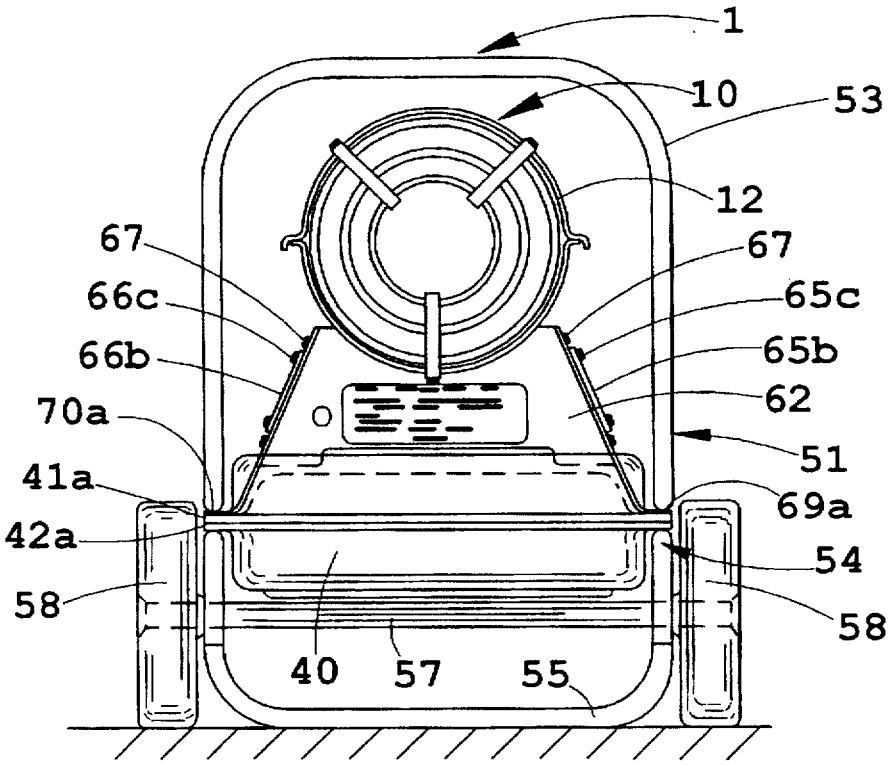
FIG. 3 is a rear elevational view of the portable heater as disclosed in FIG. 1.

It will be noted as disclosed in FIGS. 3–5 that the top part 41 of tank 40 includes cutouts through which the legs 69 and 70 extend. This design permits the support plates 65 and 66 to be straight pieces as will be observed in FIGS. 5 and 6. It will also be noted that plates 65 and 66 include access openings 65*a* and 66*a*, respectively, for providing access to the inside of the compartment between the two plates 65 and 66. These openings 65*a* and 66*a* are normally covered by the cover plates 65*b* and 66*b* and are secured in place by the metal screws 65*c* and 66*c*.

SECOND EMBODIMENT

Figure 7:
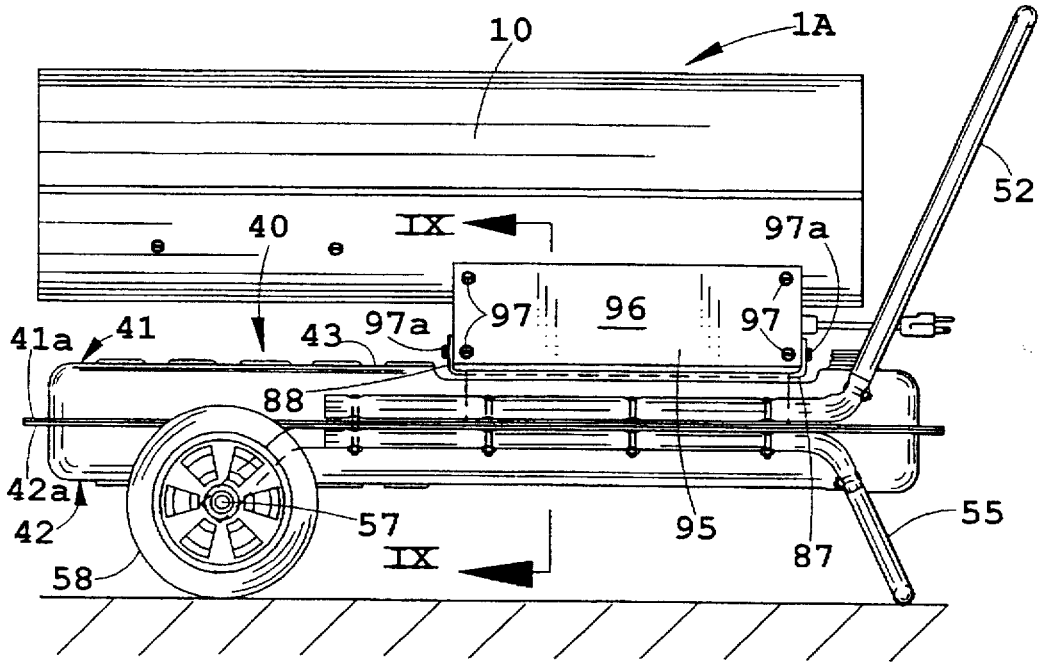
FIG. 7 is a side elevational view of a second embodiment of our portable heater.
Figure 8:
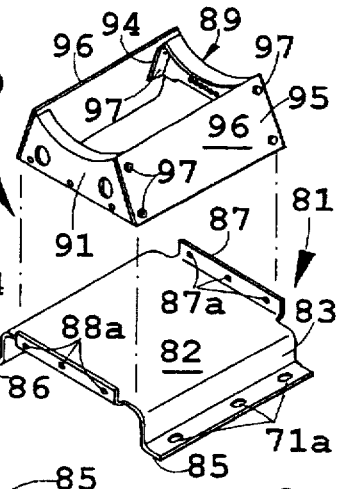
FIG. 8 is an exploded perspective view of the support structure for the heater unit as disclosed in FIG. 7.
Figure 9:
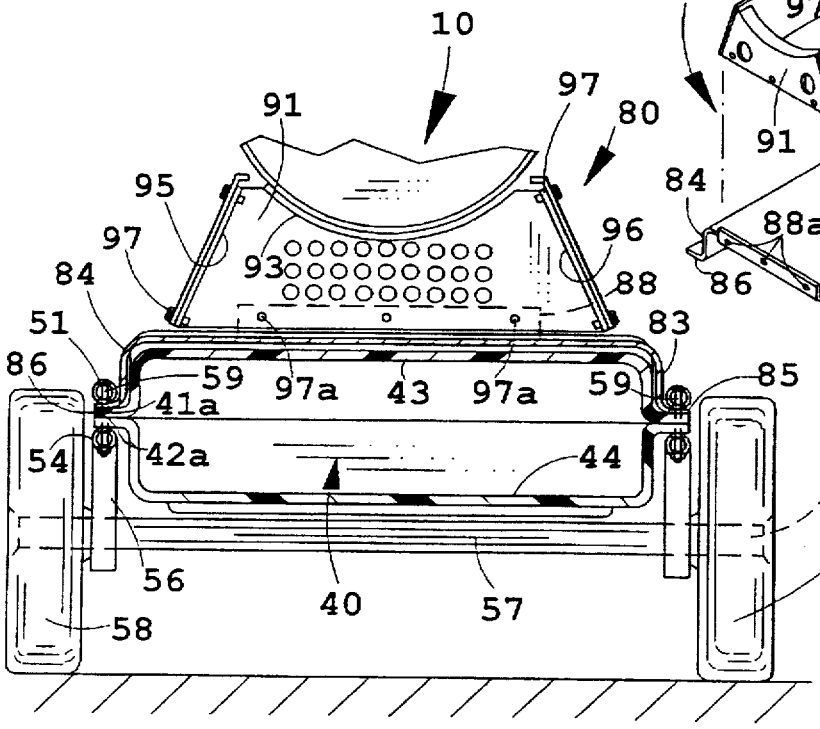
FIG. 9 is a partial cross-sectional view taken along the plane IX—IX of FIG. 7.

Another embodiment of this invention is disclosed in FIGS. 7–9. As will be noted, FIG. 7 does not disclose any of the components of the heater unit 10 except the outer cowling. It should be understood that in this second embodiment, the heater unit 10 is identical to that disclosed in relation to FIG. 1.

Now referring to FIG. 8, reference numeral 80 discloses the second embodiment of our invention which includes support structures for supporting the heater unit 10. The support structure 80 comprises two parts. The first part 81 is an inverted U-shaped support member having a bight portion 82 and the legs 83 and 84 on each side thereof. This U-shaped part 81 as disclosed in FIG. 9 has substantially the same configuration as the top part 41 of tank 40. It thus fits over the top portion 41 with the legs extending downwardly and including flanges 85 and 86 that extend between the two elongated tubular elements 51 and 54 on each side of the tank 40. The part 81 includes the upstanding flanges 87 and 88 both having openings 87*a* and 88*a*, respectively.

The second part 89 of the support structure 80 of FIGS. 7–9 provides a cradle support for heater unit 10 and is somewhat like the cradle support 60 of FIG. 6. Thus, it includes the two end plates 90 and 91 having flanges 92 and 93, respectively, with concave shapes corresponding to the shape of cowling 12 of heater unit 10. These end plates also include the flanges 94 like that of flanges 68 of FIG. 6. Plates 95 and 96 are mounted on the flanges 94 by screws 97.

The entire part 89 is secured to the flanges 87 and 88 by locating the end plates 90 and 91 between the flanges 87 and 88, respectively. The attachment is made by screws 97 extending through the openings 87*a* and 88*a* which are aligned when part 80 is inserted between the two flanges 87 and 88.

Figure 1A:
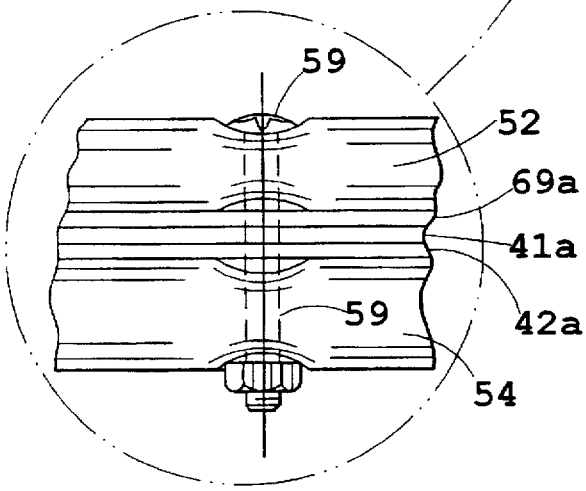
FIG. 1A is an enlarged view of a portion of the structure of FIG. 1.
Figure 2:
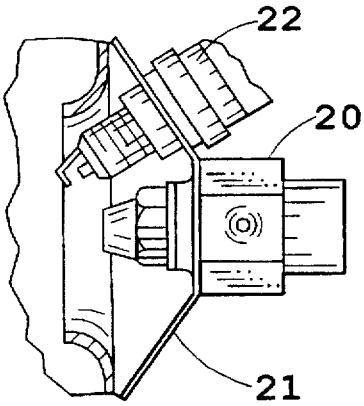
FIG. 2 is a partial cross section taken along the plane II—II of FIG. 1.

The assembly constituting the support structure 80 is secured to the frame 50 by inserting the flanges 41*a* and 41*b* between the frame members 51 and 54 and securing them together by bolts 59 extending through openings 71*a* as disclosed in FIGS. 1A and 9.

It should be evident from the description of the cradle supports described above in the first and second embodiment that the second embodiment also protects the tank 40 from any substantial stress exerted by the weight of the heater unit as it is mounted above the tank.

While we have described specific structural features of our invention, it should be understood that the invention is not limited to such specific features and that other forms or modifications made within the spirit of this invention are conceivable within one skilled in the art. Therefore, this invention shall be limited only within the legitimate and valid scope of the appended claims.

The invention claimed is:

1. In a portable heater having an elongated heater unit mounted over a tank by a cradle, said tank having a top, a bottom, ends, and elongated sides supported on a frame having first support members extending along said elongated sides, the improvement comprising:

said tank being constructed of plastic;

said cradle including a support surface on which said heater unit is supported; and said cradle being supported by second support members extending downwardly from said cradle and ultimately supported on said first support members of said frame.

2. The portable heater of claim 1 in which said second support members each include a part extending laterally outwardly of said support surface over said first support members and supported on said first support members of said frame.

3. The portable heater of claim 2 in which each of said parts includes an extension of said second support member, said extension terminated in a support flange supported on a first support member of said frame.

4. The portable heater of claim 3 in which such extensions and second support members are one-piece.

5. The portable heater of claim 4 in which said cradle, second support members, and extensions are one-piece.

6. The portable heater of claim 3 in which such extensions are separate parts to which said second support members are secured.

7. The portable heater of claim 6 in which said extensions are each formed by an inverted metallic U-shaped member having a central bight portion extending over said plastic tank, said extensions located on the ends of said bight portion, and said second support members are secured to and supported by said bight portion.

8. The portable heater of claim 1 in which said support members are elongated parallel tubes extending at a lower level than said heater unit along the sides of said tank.

9. The portable heater of claim 1 in which said plastic tank is constructed of two rectangular, cup-shaped, plastic parts each having a peripheral flange extending outwardly of their peripheries, one of said cup-shaped parts being inverted and located on the other of said cup-shaped parts with the peripheral flanges thereof engaged and secured to each other; said tank being supported on each side thereof by said peripheral flanges supported on portions of said elongated support members of said frame.

10. The portable heater of claim 9 in which said peripheral flanges on each side of said tank are located between two elongated members of said frame.

11. In a portable heater having an elongated heater unit mounted over a tank by a cradle, said tank having a top, a bottom, ends, and elongated sides supported on a frame having support members extending along said elongated sides, the improvement comprising:

said tank being constructed of plastic;

said cradle comprising a tower having two spaced legs extending upwardly directly from said frame support members and inclined toward each other; and said legs extending past at least a portion of the sides of said tank and supporting at their upper ends a concave support surface on which said heater unit is mounted.

12. The portable heater of claim 11 in which said plastic tank is constructed of two rectangular, cup-shaped, plastic parts each having a peripheral flange extending outwardly of their peripheries, one of said cup-shaped parts being inverted and located on the other of said cup-shaped parts with the peripheral flanges thereof engaged and secured to each other; said tank being supported on each side thereof by said peripheral flanges mounted on portions of said elongated support members of said frame.

13. The portable heater of claim 12 in which said peripheral flanges on each side of said tank are located between two elongated members of said frame.

14. The portable heater of claim 11 in which said support members are elongated parallel tubes extending at a lower level than said heater unit along the sides of said tank and supported on wheels; said legs having support flanges attached to and supported on said parallel tubes.

15. In a portable heater having an elongated heater unit mounted over a tank by a cradle, said tank having a top, a bottom, ends, and elongated sides supported on a frame having support members extending along said elongated sides, the improvement comprising:

said tank being constructed of plastic;

an inverted metallic U-shaped member having a bight portion with a first leg on one of its sides and a second leg on the other of its sides;

said bight portion extending laterally across the top of said tank;

said first leg extending downwardly from said bight portion over at least a portion of one side of said tank;

said second leg extending downwardly from said bight portion over at least a portion of the other side of said tank;

said first and second legs attached to and supported by said support members of said frame and thereby supporting said bight portion above said tank;

a second inverted U-shaped member having a third leg and a fourth leg spaced from each other and extending upwardly from said bight portion of said first U-shaped member;

said third and fourth leg supporting a concave support surface with said heater unit supported thereon; and said third and fourth legs being attached to and supported by said bight portions whereby substantially all the weight of said heater unit is sustained by said first inverted U-shaped member.

16. The portable heater of claim 15 in which said plastic tank is constructed of two rectangular, cup-shaped, plastic parts each having a peripheral flange extending outwardly of their peripheries, one of said cup-shaped parts being inverted and located on the other of said cup-shaped parts with the peripheral flanges thereof engaged and secured to each other; said tank being supported on each side thereof by said peripheral flanges mounted on portions of said elongated support members of said frame.

17. The portable heater of claim 16 in which said peripheral flanges on each side of said tank are located between two elongated members of said frame.

18. In a portable heater having an elongated heater unit mounted over a tank by a cradle, said tank having a top, a bottom, ends, and elongated sides supported on a frame having first support members extending along said elongated sides, the improvement comprising:

said tank being constructed of plastic; and a support structure supported on said frame and extending upwardly from said frame above the top surface of said frame, said support structure supporting said cradle and heater so as to substantially eliminate any stress being exerted on said plastic tank by the weight of said heater unit.

19. The portable heater of claim 18 in which said cradle is supported by spaced legs on each side of said plastic tank, said legs extending downwardly toward one of the sides of said tank, said legs each having a part extending outwardly of one of the sides of said plastic tank and over one of said first support members of said frame and supported thereon.

20. The portable heater of claim 19 in which said legs and part are one-piece.

21. The portable heater of claim 19 in which said legs and parts are separate elements secured to each other.

22. The portable heater of claim 21 in which said elements are formed by an inverted U-shaped element having a central bight portion extending laterally over and above said top of said plastic tank and said part having downwardly extending extensions located on the sides of said bight portion adjacent the sides of said plastic tank, said legs being secured to and supported by said bight portion and each of said extensions being mounted on said elongated support members.

* * * * *